US010400189B2

(12) United States Patent
Dobala

(10) Patent No.: US 10,400,189 B2
(45) Date of Patent: Sep. 3, 2019

(54) GASOLINE ENGINE LUBRICANT

(71) Applicant: Ronald J. Dobala, East Aurora, NY (US)

(72) Inventor: Ronald J. Dobala, East Aurora, NY (US)

( * ) Notice: Subject to any disclaimer, the term of this patent is extended or adjusted under 35 U.S.C. 154(b) by 3 days.

(21) Appl. No.: 15/297,620

(22) Filed: Oct. 19, 2016

(65) Prior Publication Data

US 2017/0183591 A1 Jun. 29, 2017

Related U.S. Application Data

(60) Provisional application No. 62/271,868, filed on Dec. 28, 2015.

(51) Int. Cl.

| | |
|---|---|
| ***C10M 169/04*** | (2006.01) |
| ***C10L 1/14*** | (2006.01) |
| ***C10L 1/16*** | (2006.01) |
| ***C10L 1/18*** | (2006.01) |
| ***C10L 10/08*** | (2006.01) |
| ***C10M 163/00*** | (2006.01) |
| ***C10M 177/00*** | (2006.01) |
| *C10L 1/182* | (2006.01) |

(52) U.S. Cl.

CPC ..... *C10L 10/08* (2013.01); *C10L 1/14* (2013.01); *C10M 163/00* (2013.01); *C10M 169/045* (2013.01); *C10M 177/00* (2013.01); *C10L 1/1616* (2013.01); *C10L 1/1802* (2013.01); *C10L 1/1824* (2013.01); *C10L 2200/0423* (2013.01); *C10L 2200/0469* (2013.01); *C10L 2200/0484* (2013.01); *C10L 2270/023* (2013.01); *C10L 2290/24* (2013.01); *C10M 2203/1006* (2013.01); *C10M 2207/021* (2013.01); *C10M 2207/40* (2013.01); *C10N 2220/022* (2013.01); *C10N 2230/06* (2013.01); *C10N 2230/70* (2013.01); *C10N 2240/10* (2013.01); *C10N 2240/105* (2013.01)

(58) Field of Classification Search

CPC .. C10L 10/08; C10L 1/023; C10L 2200/0423; C10L 2270/023; C10L 2290/24; C10L 1/14; C10L 1/1616; C10L 1/1802; C10L 1/1824; C10L 2200/0484; C10L 2200/0469; C10M 169/045; C10M 2203/1006; C10M 2207/021; C10M 2207/40; C10M 163/00; C10M 177/00; C10N 2240/105; C10N 2230/06; C10N 2230/70; C10N 2240/10

See application file for complete search history.

(56) References Cited

U.S. PATENT DOCUMENTS

| | | | | |
|---|---|---|---|---|
| 2006/0089272 | A1* | 4/2006 | Bardasz | C10M 133/56 508/294 |
| 2007/0056213 | A1* | 3/2007 | French | C10L 1/02 44/385 |
| 2007/0113467 | A1* | 5/2007 | Abou-Nemeh | C10L 1/143 44/388 |
| 2007/0204605 | A1* | 9/2007 | Itoga | B60W 10/06 60/433 |
| 2008/0184952 | A1* | 8/2008 | Athans | C10L 1/06 123/1 A |

FOREIGN PATENT DOCUMENTS

| | | | | |
|---|---|---|---|---|
| WO | WO2009029427 | | 3/2009 | |
| WO | WO-2009135307 | A1 * | 11/2009 | C10L 1/02 |

OTHER PUBLICATIONS

U.S. Appl. No. 12/769,585, filed Oct. 28, 2010, Joseph Timar.

* cited by examiner

*Primary Examiner* — Latosha Hines

(74) *Attorney, Agent, or Firm* — Vincent G. LoTempio; Kloss, Stenger & LoTempio; David T. Stephenson

(57) ABSTRACT

An engine lubricant comprising an oil and additives and method of making and using the same. The engine lubricant is based on process of sequentially combining a specific amount isopropyl alcohol, fuel stabilizer, corn oil and motor oil to produce a lubricant that prevents phase separation. The engine lubricant may be combined with gasoline to produce a two-cycle engine fuel. Alternatively, the engine lubricant may be used to lubricate 4-cycle engines. Prevention of phase separation in the engine lubricant provides longer engine life and reduced engine wear in both two-cycle and four-cycle engines.

1 Claim, No Drawings

GASOLINE ENGINE LUBRICANT

This application claims the benefit of U.S. Provisional Application No. 62/271,868, filed on Dec. 28, 2015. The present disclosure relates to a lubricant for a two-cycle engine. The function of a lubricant in a two-cycle engine is to lubricate and cool moving parts. In a two-cycle engine lubricant is burnt along with fuel, leaving deposits of combustion products in the exhaust, the exhaust port, the combustion chamber and on the piston. These deposits lead to a decrease in the engine performance and they reduce the total working life of the engine and the exhaust.

BACKGROUND

Modern two-cycle lubricants usually comprise a combination of additives and base oil, along with a thickener and solvent. The additives are typically detergents, dispersants and antioxidants. The detergents or formulated additive packages are added to lubricants to minimize accumulation of deposits.

In conventional two-cycle lubricants, the base oils are carriers for the additives and they aid in the load carrying capability of the lubricant. Conventional lubricants have disadvantages that can affect the longevity of the engine. These disadvantages include excessive smoking of the motors while in operation, fouling of the spark plugs, clogging of the spark arrestor, excessive carbon deposits on power valves, clogging of the rings inside the motor, stalling during prolonged use and difficulty in starting on a daily basis, particularly if the engine has not been used frequently, in which case a mechanic may be required to service the engine. Further, conventional lubricants may create suboptimal performance and cause the engine to run at suboptimal revolutions per minute (RPM).

The base oils that are routinely chosen for two-cycle lubricants can separate from additives and lead to deposits and the associated problems discussed above, including blocking the exhaust port and progressively clogging the exhaust. Phase separation involving ethanol and water, which are heavier than the oil and fuel, leads to a layer of ethanol and associated water in the bottom of the fuel tank. When the ethanol and water layer is taken into the engine, engine inefficiency and damage may result. Phase separation can lead to reduced top speed and increased fuel consumption, resulting in poor combustion and increased emissions.

In conventional, commercially available two-cycle lubricants, the lubricity or load carrying capability is generally within an acceptable range. However, when phase separation occurs, deposits created by combustion may cause decreased engine performance and possibly lead to engine damage.

SUMMARY

The aim of the present disclosure is to provide a new formulation for a combination of base oil and additives for a two-cycle lubricant that prevents phase separation and provides for a cleaner and longer lasting engine. It is a further aim of the present invention to provide an engine lubricant that will not block exhausts and catalysts, and will minimize wear and tear on an engine and maintain excellent levels of cleanliness, whilst maintaining high load carrying capacity. The advantages of the lubricant of the present disclosure stem primarily from a reduction in phase separation that commonly occurs when engine lubricants are left unused over a period of time in a fuel tank.

In two-cycle fuel, after combining a conventional lubricant with gasoline, phase separation occurs with ethanol in the fuel bonding to water molecules, which creates separation where the heavier ethanol and water molecules sink to the bottom of the fuel tank, while the lighter oil and gasoline rise above the ethanol and water layer. In two-cycle engines, the engine then first takes in the separate layer of ethanol and water leading to corrosion and fouling of the engine. Therefore, an oil lubricant that can prevent phase separation is a long felt need in the industry.

The formulation of the present disclosure consists of a series of components that when combined together, in an ordered sequence, measured in specific volumes, blended with a base of motor oil unexpectedly prevented phase separation for two-cycle fuel when mixed with gasoline. This combination provides improved performance over existing two-cycle engine lubricant and gasoline combined fuels. The lubricant of the present disclosure is also effective as motor oil in four-cycle engines. The prevention of phase separation of the lubricant in four-cycle engines is beneficial for engines that experience long rest periods and are subject to varying temperatures.

The following combination of components listed below, measured in milliliters, are necessary to create the optimal interaction between and ratio of the combined substances that will produce oil to gasoline, thus creating a mixture to be used for consumption in two-cycle motors. The fuel formulation is generally combined at approximately between a 32:1 ratio of gasoline to the lubricant of the present disclosure (Lubricant A) to a 50:1 ratio of gasoline to Lubricant A to form a lubricating fuel mixture.

Lubricant A may be combined with 1 gallon of gasoline. The components included herein are combined in the sequential order defined herein, in specific amounts. Described below are a brand-specific optimal mixture and a generic optimal mixture. Isopropyl alcohol is first combined with fuel stabilizer, then corn oil is added, followed by motor oil. The motor oil may be 10W-30, 5W-30, 5W-20, OW-30, OW-20 and/or other comparable motor oils as would be known to one of ordinary skill in the art.

The additives to the base oil include 100% isopropanol, where a suitable commercially available isopropanol is Mac's 7100 Thermo-Aid. Suitable fuel stabilizers include, but are not limited to, Lucas™ Flex Fuel Ethanol Fuel Conditioner with Stabilizers, Lucas™ Fuel Stabilizer, Sta-Bil™ Fuel Stabilizer, PRI-G™ and Max-Clean™ royal purple 11722 max clean fuel system cleaner and stabilizer. Suitable corn oil includes, but is not limited to, 100% pure Mazola™ corn oil. Suitable conventional motor oil includes, but is not limited to, Pennzoil™ 10W-30 motor oil.

DETAILED DESCRIPTION

The invention will now be described with reference to the following examples:

EXAMPLES

The base oil of the lubricant (Lubricant A) of the present disclosure used in the following examples includes:

TABLE 1

| Base Oil | Preferred Brand | Availability |
|---|---|---|
| 10w-30 Motor Oil | Pennzoil 10W-30 | Pennzoil Co. |

The additives for Formulation A used in the following examples include:

TABLE 2

| Additive | Preferred Brand | Availability |
|---|---|---|
| Isopropyl Alcohol | Mac's 7100 Thermo-Aid | NAPA Chemicals |
| Fuel Stabilizer | Lucas Flex Fuel | Lucas Oil Co. |
| Corn Oil | 100% Pure Mazola Corn Oil | Mazola Co. |

The components of Lubricant A, in the preferred embodiment, are blended by a sequential adding process where, in the first step, the Mac's 7100 Thermo-Aid is added to the Lucas Flex Fuel. In the second step, the 100% pure Mazola Corn Oil is added to the combined Mac's 7100 Thermo-Aid and Lucas Flex Fuel. In the third step, the combined Mac's 7100 Thermo-Aid, Lucas Flex Fuel and 100% Mazola Corn Oil is added to the Pennzoil 10W-30 Motor Oil. After this sequential process of combining the components, the mixture was blended by gentle shaking. 15 seconds of shaking is generally sufficient to blend the components of the lubricant prior to adding the lubricant to gasoline.

It is important to combine the components of the formula in accordance with the sequential process described herein. When the components are combined in the disclosed sequential order, the components form a homogenous mixture. If the steps of the method of the present disclosure are not followed the components do not homogenize. Corn oil is surprisingly effective in generating the necessary homogenization of components when compared to other oils. The homogenization is an unexpected result and is critical for effectiveness of the present disclosure.

After combining Lubricant A with gasoline, the mixture is generally allowed to rest for at least one hour prior to use. When combining the lubricant with gasoline, no shaking is required for blending. Once combined, the lubricant and the present disclosure, the component amounts in vol. % for a preferred embodiment are disclosed in the table below.

Lubricant A (Brand Specific Optimal Mixture)

Add in sequential order:

| | | |
|---|---|---|
| 1. | Mac's 7100 Thermo-Aid | 2.46 ml (2.079 vol %) |
| 2. | Lucas Flex Fuel | 1.23 ml (1.040 vol %) |
| 3. | 100% Pure Mazola Corn Oil | 0.18 ml (0.152 vol %) |
| 4. | Pennzoil 10W-30 Motor Oil | 114.42 ml (96.729 vol %) |

After approximately 15 seconds of gentle shaking, add the above combined mixture to 3785 mL (1 gallon) of gasoline. The amounts of oil and additives are disclosed in generic terms below:

Lubricant A (Generic Specific Preferred Mixture)

Add in sequential order:

| | | |
|---|---|---|
| 1. | Isopropyl Alcohol | 2.46 ml (2.079 vol %) |
| 2. | Fuel Stabilizer | 1.23 ml (1.040 vol %) |
| 3. | Corn Oil | 0.18 ml (0.152 vol %) |
| 4. | Motor Oil | 114.42 ml (96.729 vol %) |

Add the above combined mixture to 3785 mL (1 gallon) of gasoline.

The vol. % of the components of Lubricant A listed above, may be optimally adjusted between approximately +5% and −5% of the first three components (isopropyl alcohol, fuel stabilizer and corn oil) and making up the difference with motor oil. In some embodiments, the isopropyl alcohol may vary between 2%-3.5%. The fuel stabilizer may vary between 0.75% and 1.75%. The corn oil may vary between 0.1% and 0.25%. Motor oil may be added to the first three components in approximately a 95-97 vol. % and may optimally vary depending on the ratio of gasoline to Lubricant A in the final fuel mixture. Optimally, the formulation comprises a sequential, stepwise process involving:

1. adding 1.975 to 2.183 vol. % isopropyl alcohol to a vessel;
2. adding 0.988 to 1.092 vol. % fuel stabilizer to the vessel;
3. adding 0.144 to 0.160 vol. % corn oil to the vessel;
4. adding 96.565 to 96.893 vol. % 10W-30 motor oil to the vessel to form the lubricant.

With regard to the fuel stabilizer component, a number of fuel stabilizers will achieve similar results. There are numerous commercially available formulations for gasoline stabilization that are commercially available and known to one of ordinary skill in the art and will work in accordance with the present disclosure. With regard to the corn oil component, 100% Mazola corn oil is preferably used, although other corn oils may also be effective. With regard to the base oil, 10W-30, 5W-30, 5W-20, OW-30, OW-20 and/or other comparable motor oils as would be known to one of ordinary skill in the art may be used in the present disclosure. The formulation is generally combined at approximately between a 32:1 ratio of gasoline to lubricant (Lubricant A) of the present disclosure to a 50:1 ratio of gasoline to lubricant (Lubricant A) to form a lubricating fuel mixture.

The list of components used in testing of the present disclosure is included below:

Lubricant A is Applicant's formulation in a preferred range approximate.

Lubricant B is Troybilt Remington MTD P/N 147543.

Lubricant C is ECHO Premium two-cycle engine oil with fuel stabilizer.

Lubricant D is Valvoline two-cycle Marine Oil TC-W3.

Lubricant E is Craftsman 50:1 Mix High Performance two-cycle Fuel.

Example 1

Two identical blowers (Bolens BL125 two-cycle 25 cc) were tested to evaluate continual performance time. Lubricant A is applicant's formulation. Lubricant B is competing synthetic two-cycle oil.

TABLE 3

| Lubricant | Run Time (hrs.) |
|---|---|
| A | 16.0+ |
| B | 12.5 |

Results:

Lubricant A ran the blower for 16.0 hours prior to terminating testing, and an additional 22 hours without changing the fuel mixture after the testing phase was complete. Lubricant B caused the engine to fail at 12.5 hours. Therefore, Lubricant A significantly outperformed a comparable lubricant in the run time test on a blower.

Example 2

Two identical Bolens BL 125 two-cycle Blower 25 CC 180 MPH Air Speed/400 CFM Air Volume were purchased new from a Lowes Home Improvement Store. Lubricant A, of the present disclosure, was used in one of the blowers, while Lubricant B (Troybilt Remington MTD P/N 147543 two-cycle Oil) was used in the other blower. Both units were filled with the appropriate gas/oil mix and started. Both units were run for various hours at least 1 hour per day. A log of hours run was kept. Table 4 shows the data from Example 2.

TABLE 4

| Lubricant | Total Run Time | Run Temperature | Run Performance | Engine Condition After Run | Engine Reparability After Run |
|---|---|---|---|---|---|
| A | 42.5 (engine still running at termination of test). | Warm to touch | Ran well | Little wear and tear; cleaner and free or buildup on the sparkplug | Would likely run if reassembled |
| B | 32.0 (engine stalled and could not be restarted) | Hot to touch | Stalling at days 6, 7 and 8; could not restart on day 9 | Significant wear; scarring of the cylinder; heavy carbon buildup on the spark plug | Could not be re-assembled due to wear of the interior operating parts |

Results:

The blower using Lubricant A was still running after a 42.5 hour test period. The engine of the blower using Lubricant B failed after 8 days (32.0 hours total) of use. Lubricant A allowed the new blower to run through day 9 until it was subsequently turned off, at a lower temperature, with better performance and much less wear and tear on the engine than Lubricant B.

Example 3

A 1990 Echo Series Blower Model # PB-210E was used for a period of 26 years at approximately 3 hours per week during the months of April through November, 2106. After this period, the blower was dismantled and the inner components and carburetor of the unit were photographed to document the condition of the engine. There was remarkable lack of wear and tear on the components, the carburetor was clean, and the motor was in excellent condition overall. Lubricant A is a preferred embodiment of the disclosure. The condition of the engine, in terms of wear and tear, was rated with 1 being a new machine and 10 being a worn out machine. Table 5 shows the data from Example 3.

TABLE 5

| Lubricant | Engine Condition |
|---|---|
| A | 2 |

Results:

The blower using Lubricant A left the machine in excellent condition even after a prolonged period of use where, according to a United States Environmental Protection Agency report, the median life for a commercial leaf blower is 2.3 years. (https://www3.epa.gov/otaq/models/nonrdmdl/p02014.pdf).

Example 4

Lubricant A along with 3 leading brands of two-cycle engine oil lubricants (C-E) were mixed with gasoline and tested under extreme heat and cold conditions. Lubricant C is produced by a major manufacturer of law and garden equipment. Lubricant D is produced for use in outboard boat motors. Lubricant E is produced by a leading manufacturer of the new pre-mixed two-cycle engine oil and gasoline and is widely commercially available. For the heat test, the lubricants were heated from room temperature to 100 degrees Fahrenheit. For the cold test, the experiment was conducted over 7 days, where each test lubricant was cooled from room temperature to freezing temperatures (0 degrees Fahrenheit) then removed. The time for measurement of separation after extreme temperature exposure is between 30 secs and 1 minute. Results were measured on a scale of 1-10 where 1 prevented separation and 10 did not. Table 6 shows the data from Example 4.

TABLE 6

| Lubricant | Heat Separation | Cold Separation |
|---|---|---|
| A | 1 | 1 |
| C | 6 | 8 |
| D | 6 | 8 |
| E | 6 | 8 |

Results:

Lubricant A prevented separation in both hot and cold conditions, whereas other comparable products did not.

JASO Tests

Two-cycle lubricants were prepared and their performance was tested. The performance of the lubricant was determined using the JASO standards currently used to test commercially available two-cycle lubricants. There are four levels of performance: JASO FA; FB; FC; and ISO EGD. JASO FA is the lowest standard and ISO EGD is the highest standard. The performance criteria that determine the quality of a two-cycle lubricant are set out in the JASO engine test sequences, details of which are available from the Japanese Automotive Standards Organization. A short summary on each test is given below. The tests determine the two-cycle lubricant's performance in comparison to a reference two-cycle lubricant of known quality, and they give the result as an index number.

For the purposes of the present disclosure, the parameters that are measured are the JASO Exhaust System Blocking Test (JASO M-343-92) and JASO Lubricity Test (JASO M-340-92).

The JASO Exhaust System Blocking Test (JASO M-343-92) determines the two-cycle lubricant's potential for the breakdown products on combustion to build up to such a degree that they affect engine performance, possibly causing failure, reducing top speed and increasing fuel consumption. This is referred to as the Blocking Index (BIX). The minimum index result for JASO FC standard is 90 and the minimum index result for JASO FB standard is 45.

The JASO Lubricity Test (JASO M-340-92) determines the load carrying capability of the two-cycle lubricant at elevated temperatures. The minimum index result for JASO FC standard is 95 and the minimum index result for JASO FB standard is 95.

Example 5

JASO Exhaust System Blocking Test

The JASO Exhaust System Blocking Test (JASO M-343-92) test determines the two-cycle lubricant's potential for the breakdown products on combustion to build up to such a degree that they affect the engines performance, possibly causing failure, and more likely reducing top speed and increasing fuel consumption. This test results in a blocking index (BIX). The minimum index result for JASO FC standard is 90 and the minimum index result for JASO FB standard is 45.

For Lubricant A, of the present disclosure, the JASO exhaust block index=87. The result of the JASO Exhaust System Blocking Test for Formulation A demonstrates the ability of Formulation A to prevent phase separation and remain homogenous.

Example 6

JASO Lubricity Test

The JASO Lubricity Test (JASO M-340-92) determines the load carrying capability of the two-cycle lubricant at elevated temperatures. The minimum lubricity index is 95 for all grades (FB, EGB, FC, EGC, FD, and EGD).

For the present disclosure the JASO lubricity index=98 and the JASO initial torque index=102. The result of the JASO Lubricity Test demonstrates that Formulation A ranks superior with respect to lubricity when compared to the benchmark oils.

This application discloses several numerical ranges. The numerical ranges disclosed are intended to support any range or value within the disclosed numerical ranges even though a precise range limitation is not stated verbatim in the specification because this invention can be practiced throughout the disclosed numerical ranges. It is also to be understood that all numerical values and ranges set forth in this application are necessarily approximate.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

What is claimed is:

1. A sequential process to prepare an additive consisting of the following steps of:

in step 1, adding 60.39 to 66.75 vol. % isopropyl alcohol and 30.19 to 33.37 vol. % fuel stabilizer to a vessel; and in step 2, adding 4.42 to 4.88 vol. % corn oil to the vessel to form the additive.

* * * * *